United States Patent [19]

Schulz et al.

[11] 4,350,202

[45] Sep. 21, 1982

[54] EXTRACTOR FOR RECIRCULATING CLEANING BODIES IN A FLUID-CIRCULATION SYSTEM

[75] Inventors: Adalbert Schulz, New York, N.Y.; Werner Borchert, Düsseldorf, Fed. Rep. of Germany

[73] Assignee: Kleiber & Schulz, Inc., Huntington Station, N.Y.

[21] Appl. No.: 66,380

[22] Filed: Aug. 14, 1979

[51] Int. Cl.[3] ..... F28G 9/00

[52] U.S. Cl. ..... 165/95; 15/3.51

[58] Field of Search ..... 165/95; 15/3.51

[56] References Cited

U.S. PATENT DOCUMENTS

| | | | |
|---|---|---|---|
| 3,021,117 | 2/1962 | Taprogge | 165/95 |
| 4,113,008 | 9/1978 | Treplin | 165/95 |
| 4,234,993 | 11/1980 | Kintner | 165/95 |

*Primary Examiner*—Samuel Scott
*Assistant Examiner*—Theophil W. Streule, Jr.
*Attorney, Agent, or Firm*—Karl F. Ross

[57] ABSTRACT

A fluid-circulation system, specifically a heat exchanger with entrance and exit ducts interconnected by a bank of tubes, is provided in its exit duct with an extractor for intercepting generally spherical cleaning bodies of sponge rubber or the like which are to be returned to the inlet duct via a bypass connection for recirculation through the tubes. The extractor comprises two substantially symmetrical screens, converging downward in the direction of fluid flow, which direct the oncoming cleaning bodies into a narrow collecting box having a sloping bottom near one or more outlets forming part of the bypass connection. The two screens have generally planar confronting surfaces and are swingable about respective transverse axes into a downwardly diverging position in which their opposite surfaces are exposed to the flow for cleansing purposes during a regeneration phase. At least one sidewall of the collecting box is secured to the adjoining screen for separation, together with the sloping box bottom, from the opposite sidewall when the two screens are swung into their regenerating position.

11 Claims, 10 Drawing Figures

EXTRACTOR FOR RECIRCULATING CLEANING BODIES IN A FLUID-CIRCULATION SYSTEM

FIELD OF THE INVENTION

Our present invention relates to a fluid-circulation system of the self-cleaning type, e.g. a heat exchanger, and more particularly to an intercepting device or extractor for separating recirculated cleaning bodies, such as sponge-rubber balls, from a carrier liquid passing through a conduit system of such a heat exchanger.

BACKGROUND OF THE INVENTION

The principle of cleaning the conduits of a heat exchanger by a multiplicity of continuously recirculating rubber balls or the like is described in U.S. Pat. No. 2,801,824. Briefly, the ball-recirculating system includes a funnel-shaped extractor with sieve-like walls inserted in a descending exit duct for the carrier liquid (e.g. cooling water) to intercept the oncoming balls and guide them via a return or bypass connection to an entrance duct serving for the admission of fresh liquid. The outflowing liquid escapes through the interstices of the funnel. The impurities detached by the cleaning bodies from the inner tube walls of the heat exchanger as well as other contaminants (e.g. algae) entrained by the carrier liquid tend to accumulate in these interstices so that the sieve members of the extractor must be periodically cleansed. For this purpose, as likewise suggested in the aforementioned U.S. patent, the funnel may be split into two halves swingable about a common pivotal axis into a wide-open position in which parts of these halves are substantially parallel to the direction of flow.

A further development of this concept, described in U.S. Pat. No. 3,269,543, comprises a sieve box of narrow horizontal cross-section disposed beneath the funnel and provided at its lower end with a throttle valve which can be closed to force the accumulating liquid above that valve through the interstices of the box walls for cleansing same.

OBJECT OF THE INVENTION

The object of our present invention is to provide an improved extractor of the general type referred to above, including a split funnel and an underlying collecting box, in which both the funnel and the collecting box can be conveniently cleansed without significant interruption of the operation of the associated heat exchanger.

SUMMARY OF THE INVENTION

In accordance with our present invention, the upper portion of the funnel of our improved extractor comprises a pair of generally flat sieves which, in a working position, converge downward from the inner periphery of the surrounding discharge duct on opposite sides of the midplane of that duct; each sieve terminates, in the working position, close to an upper edge of a respective sidewall of a narrow collecting box constituting the lower portion of the device. These sidewalls form the broad faces of the collecting box which may have a substantially rectangular cross-section. The two sieves are swingable about respective pivotal axes on opposite sides of the aforementioned midplane into a downwardly diverging regenerating position; at least one sieve is secured to the respective sidewall of the collecting box for separating same from the other sidewall upon a swing into this regenerating position whereby the collecting box is split wide open to discharge any solids accumulated therein.

Thanks to the downward divergence of the two sieves in their regenerating position, the cooling water or other carrier liquid descending through that discharge duct toward a drain strikes the sieves from their reverse sides so as to dislodge any solids clogging their interstices.

The intercepted cleaning bodies (referred to hereinafter, for convenience, as balls) leave the collecting box in the working position through one or more tubular outlets disposed in a plane transverse to the duct axis at or near the bottom of that box. The outlet or outlets are not directly connected with the bottom of the box which is perpendicular to and rigid with the swingable sidewall secured to one of the funnel halves. The opposite sidewall may be stationary, particularly if it is directly joined to such an outlet; if, however, the outlet or outlets are provided at the narrower end walls of the box, both sidewalls may be secured to the respective sieves of the funnel for swinging away from each other into the regenerating position.

The sieves constituting the two swingable funnel halves may be designed as simple screens with parallel blades or wires while the box walls can be imperforate sheets; the provision of apertured box walls is, however, by no means excluded.

In order to prevent the loss of balls when the extractor is moved into its regenerating position, the recirculation of these balls may be arrested prior to such time by conventional retaining means such as a catch basin advantageously included in the bypass connection between the entrance and exit ducts of the heat exchanger.

BRIEF DESCRIPTION OF THE DRAWING

The above and other features of our invention will now be described in detail with reference to the accompanying drawing in which.

SPECIFIC DESCRIPTION

Figure 1:
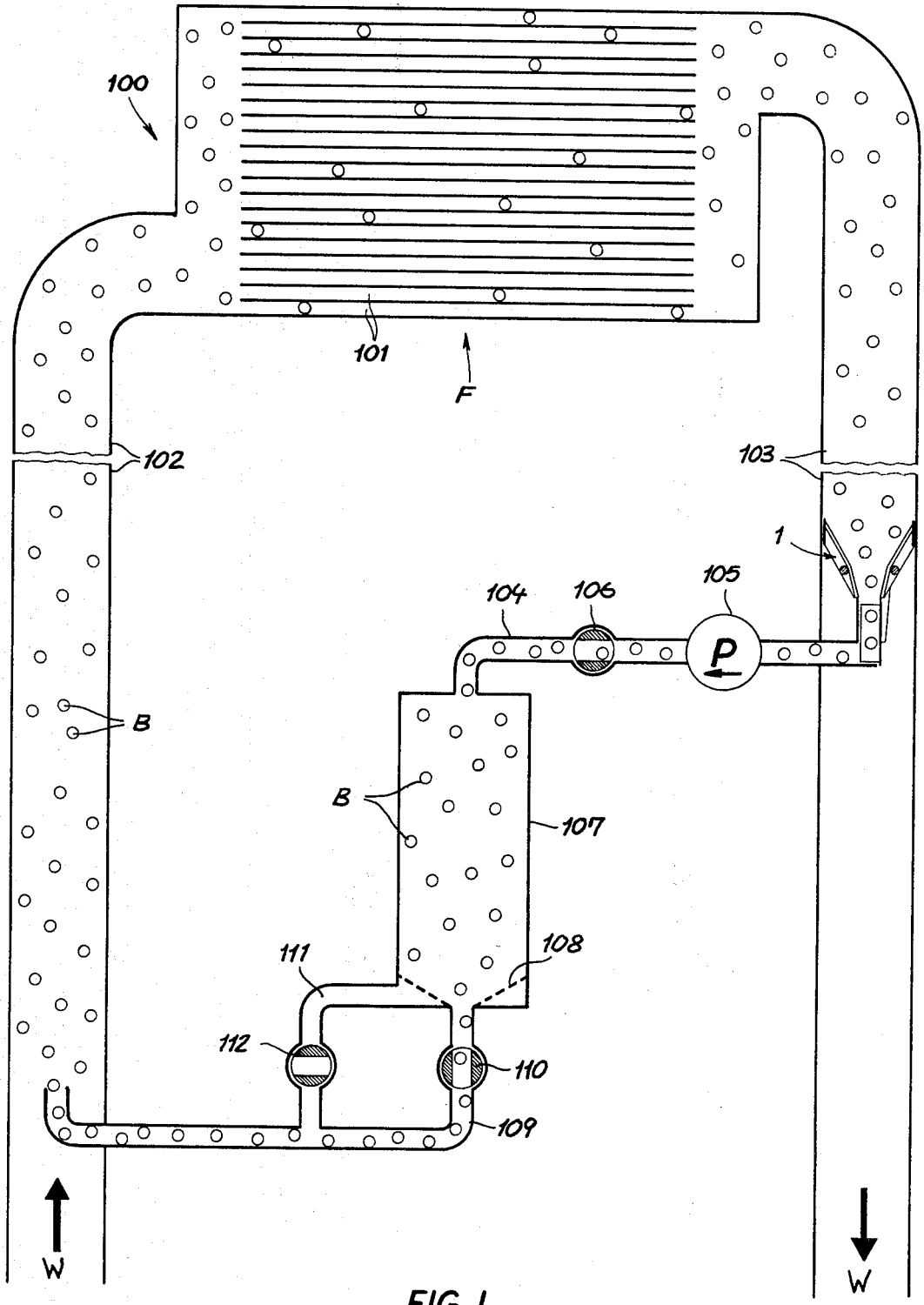
FIG. 1 is an overall diagrammatic view of a self-cleaning heat exchanger provided with an extractor according to our invention.

Reference will first be made to FIG. 1 which shows a heat exchanger 100 designed for the cooling of a fluid stream F flowing past a bank of tubes 101 through which water is continuously passed, as indicated by arrows W, via an ascending entrance duct 102 and a descending exit duct 103. The tubes 101 are continuously cleaned by a multiplicity of sponge-rubber balls B whose diameter substantially matches the inner tube diameter; these balls are entrained by the water flow and are recirculated from exit duct 103 to entrance duct 102 via a bypass conduit 104 containing a pump 105 and a shut-off valve 106 in series therewith. A catch basin 107, large enough to hold all the circulating balls B, is inserted in conduit 104 and has a funnel-shaped bottom screen 108 leading to an outlet 109 which is provided with a normally open valve 110. A branch outlet 111, normally closed by a valve 112, receives only the water traversing the screen 108 but not the balls B. When the circulation of the balls is to be halted without interrupting the operation of the heat exchanger, valve 110 is closed while valve 112 is opened to continue the recirculation of part of the cooling water until all the balls are received in catch basin 107; pump 105 may then be stopped with closure of valve 106.

Figure 2:
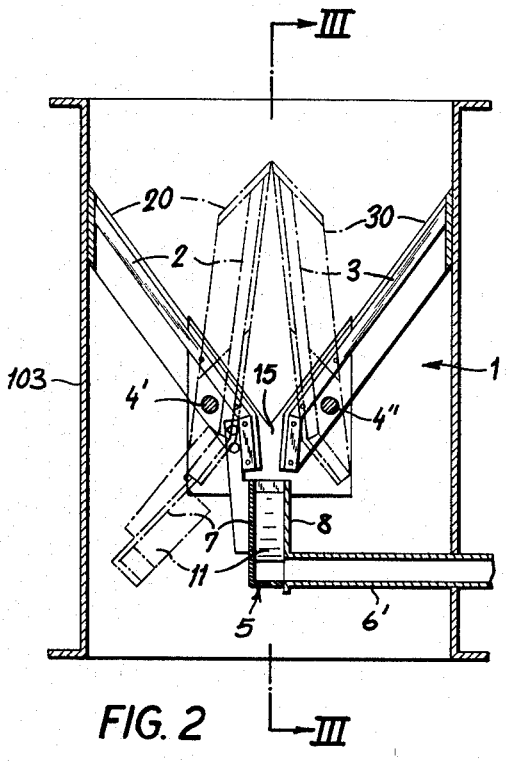
FIG. 2 is an axial sectional view, drawn to a larger scale, of the extractor disposed in an exit duct of the heat exchanger of FIG. 1.
Figure 3:
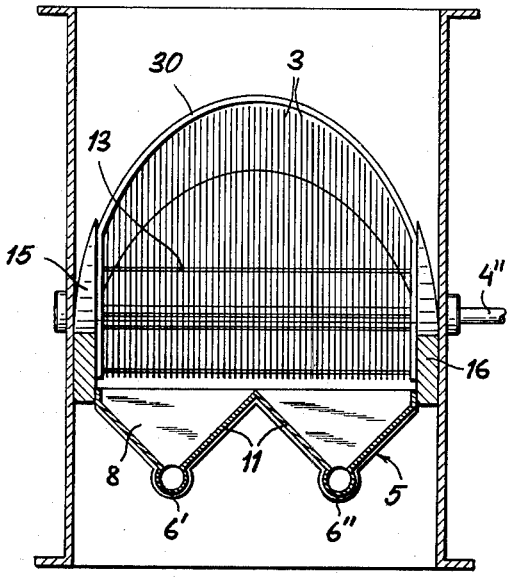
FIG. 3 is a cross-sectional view of the duct and the extractor, taken on the line III—III of FIG. 2.
Figure 4:
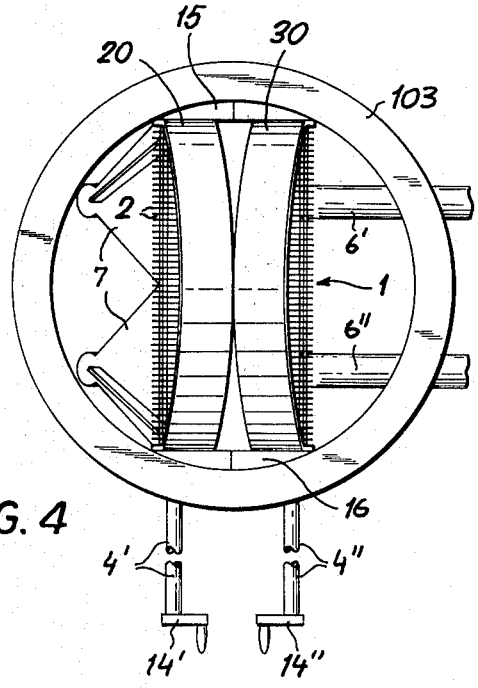
FIGS. 4 and 5 are top views of the assembly of FIGS. 2 and 3 in a regenerating position and in a working position, respectively, of the extractor.

The recirculating balls are intercepted and directed to conduit 104 by an extractor device 1 according to our invention positioned, like prior-art devices of this type, in a section of exit duct 103. As more fully illustrated in FIGS. 2–6, device 1 comprises a pair of sieves each formed by an assembly of slender parallel blades 2 and 3 lying in vertical planes, the blades being mounted in generally semielliptical frames 20, 30. These frames are independently swingable about respective pivotal axes formed by horizontal rods 4', 4'' which lie at opposite sides of an axial midplane M (FIG. 6) of the duct 103 and are provided outside that duct with handles 14', 14'' facilitating their rotation into either a working position or a regenerating position. The working position has been illustrated in full lines in FIG. 2 and also in FIGS. 3, 5 and 6; the regenerating position is shown in phantom lines in FIG. 2 and also in FIG. 4.

Figure 5:
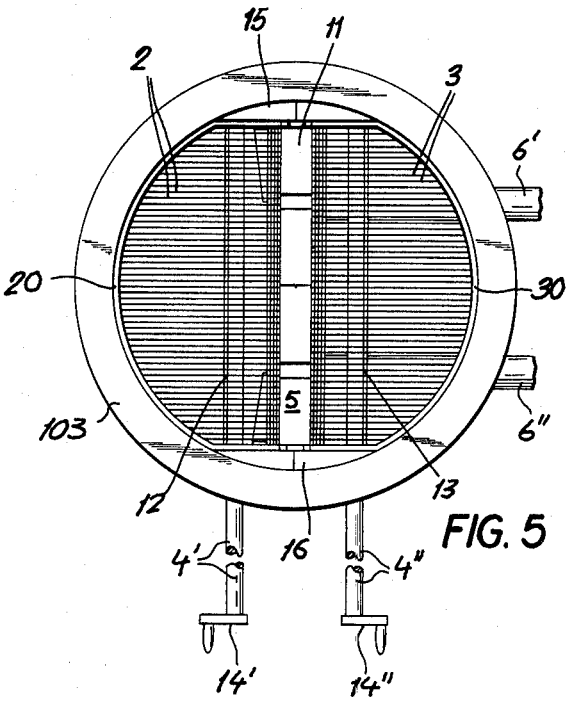

In the working position, the frames 20 and 30 lie fully against the inner peripheral wall surface of duct 103 and, together with their blade assemblies 2 and 3, converge downward to the vicinity of midplane M where they terminate just above the upper edges of two solid sidewalls 7, 8 of a collecting box 5 of generally rectangular horizontal cross-section as best seen in FIG. 5. The box also has a solid bottom 11 which in this embodiment is of serrated shape with two troughs from which a pair of outlets 6' and 6'' extend out of duct 103, merging into the return conduit 104 in a manner not further illustrated. At its narrow sides the box 5 is bounded by end walls 15, 16. The width of the box and the inner diameters of outlets 6', 6'' are, of course, sufficient to accommodate the balls B shown in FIG. 1; the ball diameter may be about 25 mm, for example.

Figure 6:
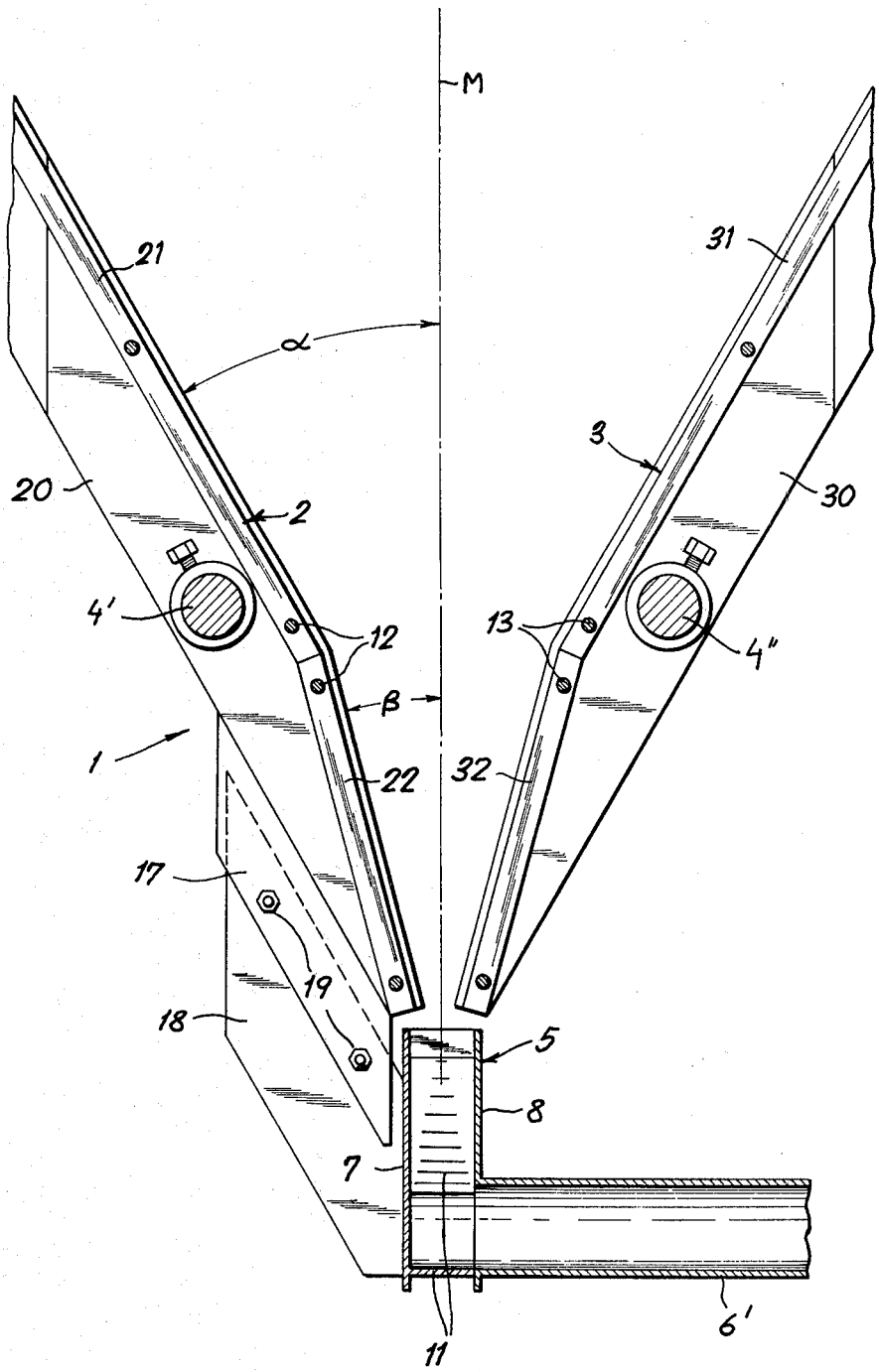
FIG. 6 is an enlarged axial sectional view of part of the extractor of FIGS. 2–5 in its working position.

In the embodiment of FIGS. 2–6, sidewall 8 and end walls 15, 16 form a stationary structure rigid with outlets 6', 6'' whereas sidewall 7 rigid with bottom 11 is separable from that structure and is secured to frame 20 with the aid of overlapping lugs 17 and 18 bolted together at 19 as best seen in FIG. 6. Thus, upon a rotation of the two sieves 2, 20 and 3, 30 into their regenerating position in which the frames 20 and 30 touch each other at midplane M, sidewall 7 and bottom 11 are swung away from that midplane whereby the box is opened and all its walls as well as its bottom can be flushed by the water flowing through duct 103; thus, no solids swept off the sieve surfaces can accumulate near outlets 6', 6'' for possible recirculation. The water flow also strikes the rear surfaces of the downwardly diverging assemblies of blades 2, 3 and enters their interstices in the reverse direction to sweep out any solids obstructing same.

The blade assemblies 2, 3 are interconnected at intermediate locations by transverse rods 12, 13 for greater stability. As best illustrated in FIG. 6, blade assemblies 2 and 3 are divided near the level of their pivotal axes into two swctions 21, 22 and 31, 32 which form upper and lower screen portions including different angles $\alpha$ and $\beta$ with the midplane M in their working position, with $\alpha$ preferably ranging between 20° and 30° while being equal to about $2\beta$. Thus, the upper screen portions 21, 31 converge at a larger vertex angle $2\alpha$ than the lower screen portions 22, 32 having a vertex angle $2\beta$. The upper screen portions, therefore, are struck in their working position by the oncoming water with a larger velocity component transverse to the sieve surface so as to be less likely to become clogged by entrained solids than the lower screen portions. With a suitably chosen swing angle roughly equaling $(3\alpha/2)$ or 1.5 times the lower vertex angle $2\beta$, e.g. of about 30° to 45°, the lower screen portions 22, 32 will be less steeply inclined to the horizontal in their regenerating position than in their working position; the liquid impinges upon them with greater force during regeneration than on the upper screen portions 21, 31 which latter, in fact, are partly shielded by the surrounding frames 20, 30. Thus, the lower screen portions are more effectively unclogged in the regeneration stage. The width of the frames 20, 30 could, of course, be reduced—especially at the top—if it is desired to diminish their shielding effect.

Figure 7:
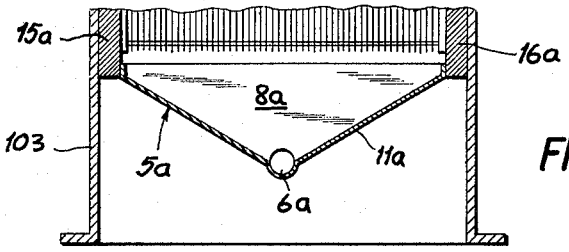
FIGS. 7, 8 and 9 are cross-sectional views of the bottom part of several modifications of the extractor shown in FIGS. 2–5.

In FIG. 7 we have shown a collecting box **5*a* which differs from the box 5 of the preceding Figures in that its bottom 11*a* is V-shaped to form a single trough registering with a transverse outlet 6*a* midway between its two end walls 15*a*, 16*a*; outlet 6*a* is fixedly secured to the stationary sidewall 8*a*** of the box.

Figure 8:
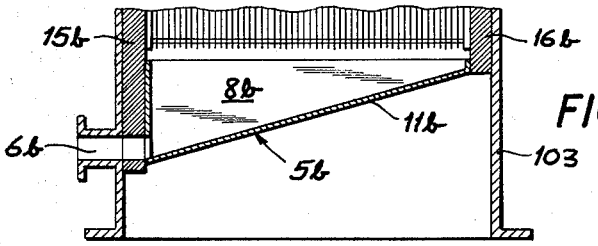

FIG. 8 shows a collecting box **5*b* with an outlet 6*b* disposed in one of its end walls 15*b*, the bottom 11*b* of that box sloping down toward this outlet from the foreshortened opposite end wall 16*b***.

Figure 9:
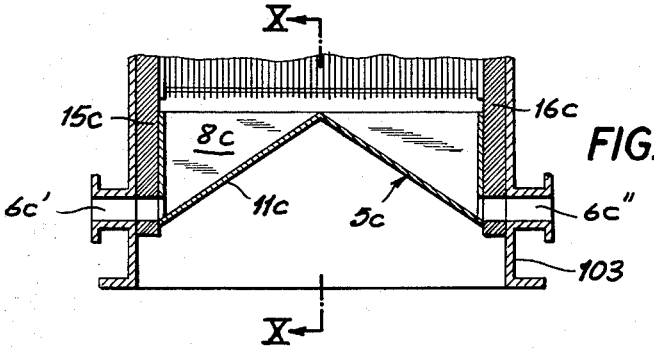
Figure 10:
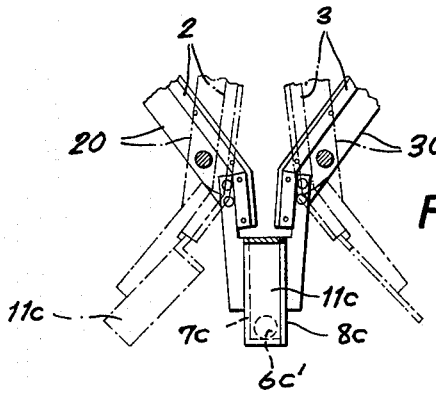
FIG. 10 is an axial sectional view taken on the line X—X of FIG. 9.

In FIGS. 9 and 10 I have shown a box **5*c* which differs from box 5*b* in that its bottom 11*c* is gable-shaped, sloping toward two aligned outlets 6*c*', 6*c*'' in end walls 15*c*, 16*c***.

Sidewalls **8*b* and 8*c* of boxes 5*b* and 5*c* need not be stationary but can be secured to the corresponding funnel half 3,30, as particularly illustrated in FIG. 10 for sidewall 8*c*, in a manner analogous to the connection between opposite sidewall 7*c* and the funnel half 2, 20 so that the two sidewalls can be swung away from the midplane of the duct for more effective cleansing. The box bottom 11*c* may again be rigid with one of its sidewalls, here specifically wall 7*c***, for joint swinging about the associated pivotal axis.

The blade assemblies 2 and 3 of the funnel-forming sieves could be replaced by wires, with substitution of wider bars traversed by these wires for the transverse reinforcing rods 12, 13.

It is to be understood that our invention is not limited to a funnel split into two halves but that the number of funnel sections, in the form of mutually complementary sieves swingable about respective axes, could also be three or more. Also, a single duct may accommodate several split funnels disposed alongside one another and coacting with respective collecting boxes.

We claim:

1. In a fluid-circulation system including an entrance duct, a descending exit duct, a bank of tubes of substantially identical inner diameter smaller than that of said ducts interconnecting the latter, an extractor in said exit duct for intercepting solid cleaning bodies entrained through said tubes by the circulating fluid and returning said bodies to said entrance duct via a bypass connection, and retaining means in said bypass connection operable to halt the recirculation of said bodies through said ducts and tubes during a regeneration phase, said extractor comprising a funnel divided into two generally flat sieves which converge downward in a working position from the inner periphery of said exit duct towards a central duct axis into a downwardly diverging regenerating position, the improvement wherein said extractor further comprises an upwardly open collecting box below said sieves whose interior opens onto tubular outlet means in a plane transverse to said duct axis communicating with said bypass connection, said box having a solid bottom just below said outlet means and further having broad faces above said bottom formed by two relatively separable sidewalls which are closely spaced from each other and from lower edges of said sieves in said working position, said bottom being integral with and substantially perpendicular to one of said sidewalls and being connected through the latter with the adjoining sieve for separation from the other sidewall and from said outlet means upon a swinging of said sieves into said regenerating position.

2. The system defined in claim 1 wherein said bottom slopes down to at least one low point, said outlet means being located at said low point.

3. The system defined in claim 1 or 2 wherein said other sidewall is stationary and rigid with said outlet means.

4. The system defined in claim 1 or 2 wherein both said sieves are secured to the respective sidewalls for joint swinging therewith in opposite directions.

5. The system defined in claim 4 wherein said collecting box has at least one stationary end wall transverse to said sidewalls provided with said outlet means.

6. The system defined in claim 1 or 2 wherein each of said sieves comprises an upper screen portion and a lower screen portion adjoining each other at an obtuse angle, said lower screen portions converging in said working position at a vertex angle smaller than that of said upper screen portion.

7. The system defined in claim 6 wherein the vertex angle of said lower screen portions is substantially half that of said upper screen portions.

8. The system defined in claim 7 wherein said sieves are swingable between said working and regenerating positions through an angle substantially equal to 1.5 times the vertex angle of said lower screen portions.

9. The system defined in claim 6 wherein said pivotal axes lie at a level close to the junctions of said upper and lower screen portions.

10. The system defined in claim 1 or 2 wherein said sidewalls are solid.

11. The system defined in claim 1 or 2 wherein said box is of generally prismatic shape with a narrow horizontal cross-section, said sidewalls being parallel to each other in said working position.

* * * * *